US011199297B2

(12) United States Patent
Schoenfelder et al.

(10) Patent No.: US 11,199,297 B2
(45) Date of Patent: Dec. 14, 2021

(54) LED LAMP

(71) Applicant: Lumileds LLC, San Jose, CA (US)

(72) Inventors: Bernd Schoenfelder, Aachen (DE); Andreas Timinger, Aachen (DE); Danijel Labas, Aachen (DE); Mark Elzinga, Roosendaal (NL)

(73) Assignee: Lumileds LLC, San Jose, CA (US)

( * ) Notice: Subject to any disclaimer, the term of this patent is extended or adjusted under 35 U.S.C. 154(b) by 94 days.

(21) Appl. No.: 16/491,540

(22) PCT Filed: Mar. 2, 2018

(86) PCT No.: PCT/EP2018/055154
§ 371 (c)(1),
(2) Date: Sep. 5, 2019

(87) PCT Pub. No.: WO2018/162341
PCT Pub. Date: Sep. 13, 2018

(65) Prior Publication Data

US 2021/0131616 A1 May 6, 2021

(30) Foreign Application Priority Data

Mar. 10, 2017 (EP) ..... 17160305

(51) Int. Cl.
*F21K 9/23* (2016.01)
*F21S 41/30* (2018.01)
(Continued)

(52) U.S. Cl.
CPC ..... *F21K 9/23* (2016.08); *F21S 41/141* (2018.01); *F21S 41/192* (2018.01); *F21S 41/30* (2018.01);
(Continued)

(58) Field of Classification Search
CPC . F21K 9/23; F21S 41/30; F21S 41/192; F21S 41/141
See application file for complete search history.

(56) References Cited

U.S. PATENT DOCUMENTS

2010/0213809 A1* 8/2010 Roehl ..... F21S 41/19 313/46
2014/0029285 A1* 1/2014 Bittinger ..... F21S 41/435 362/511
(Continued)

FOREIGN PATENT DOCUMENTS

CN 104879698 A * 9/2015
CN 104879698 A 9/2015
(Continued)

OTHER PUBLICATIONS

EPO as ISA, "International Search Report and Written Opinion" dated Jun. 6, 2018 from International Application No. PCT/EP2018/055154, filed Mar. 2, 2018, 13 pages.
(Continued)

*Primary Examiner* — Bryon T Gyllstrom
*Assistant Examiner* — Christopher E Dunay

(57) ABSTRACT

An LED lamp includes a lamp base for insertion into a reflector of an automotive front lighting assembly; a panel extending from the lamp base with a first vertical side facing into one half of the reflector and a second vertical side facing into the other half of the reflector; a primary light source including a set of LED dies on each vertical side of the panel; a two-part shield including a first shield half shielding the LED dies on the first vertical side of the panel and a second shield half shielding the LED dies on the second vertical side of the panel. The two-part shield essentially has the form of a shield in a functionally equivalent filament lamp for providing a low beam. A lighting arrangement
(Continued)

includes such an LED lamp; a reflector to receive the lamp; and an electrical interface for connecting to a controller.

18 Claims, 3 Drawing Sheets

(51) Int. Cl.

| | |
|---|---|
| ***F21S 41/19*** | (2018.01) |
| ***F21S 41/141*** | (2018.01) |
| ***F21S 41/40*** | (2018.01) |
| ***F21S 45/47*** | (2018.01) |
| *F21Y 115/10* | (2016.01) |
| *F21W 102/13* | (2018.01) |

(52) U.S. Cl.
CPC ..... *F21S 41/40* (2018.01); *F21S 45/47* (2018.01); *F21W 2102/13* (2018.01); *F21Y 2115/10* (2016.08)

(56) References Cited

U.S. PATENT DOCUMENTS

| | | | | |
|---|---|---|---|---|
| 2014/0328079 | A1* | 11/2014 | Itagaki | F21V 29/60 362/547 |
| 2016/0148798 | A1* | 5/2016 | Kowalski | F21S 41/60 362/516 |
| 2016/0290585 | A1 | 10/2016 | Lee et al. | |
| 2016/0319999 | A1* | 11/2016 | Elzinga | H01L 33/62 |
| 2017/0198875 | A1* | 7/2017 | Creusen | B60Q 1/04 |
| 2018/0306397 | A1* | 10/2018 | Matsumoto | F21S 41/663 |
| 2018/0335190 | A1* | 11/2018 | Kresge | F21S 45/47 |
| 2021/0003264 | A1* | 1/2021 | Kessels | H05B 47/105 |

FOREIGN PATENT DOCUMENTS

| | | | |
|---|---|---|---|
| TW | 201636546 | A | 10/2016 |
| WO | 2009063655 | A1 | 5/2009 |
| WO | 2015032896 | A1 | 3/2015 |
| WO | 2015091462 | A1 | 6/2015 |
| WO | 2016008738 | A1 | 1/2016 |

OTHER PUBLICATIONS

Extended European Search Report dated Sep. 25, 2017, from European Patent Application No. 17160305.3 filed Mar. 10, 2017, 8 pages.

* cited by examiner

LED LAMP

CROSS-REFERENCE TO RELATED APPLICATIONS

The present application is a § 371 application of International Application No. PCT/EP2018/055154 filed on Mar. 2, 2018 and titled "LED LAMP," which claims the benefit of European Patent Application No. 17160305.3 filed on Mar. 10, 2017. International Application No. PCT/EP2018/055154 and European Patent Application No. 17160305.3 are incorporated herein.

FIELD OF THE INVENTION

The invention describes an LED lamp, and a lighting arrangement.

BACKGROUND OF THE INVENTION

Light-emitting diodes (LEDs) are very efficient light sources that consume relatively little electrical power and which have a long lifetime. LEDs can be designed or constructed to emit light over a wide range of wavelengths, so that a very precisely tuned color temperature is possible. For these reasons, LEDs are being used in many retrofit applications, for example to replace incandescent lamps, halogen lamps, fluorescent lamps etc. In many cases, it is relatively straightforward to incorporate a carrier with one or more LED light sources, as well as any necessary electrical components, into an existing type of lamp body so that the new LED lamp can replace an existing lamp. Examples are E27 light bulbs with one or more LEDs instead of filament; tube LEDs (TLEDs) in which an array of LEDs mimics a fluorescent gas in a tube lamp; etc. However, some lamps have been developed for use in an overall system to generate a very specific beam shape, for example a specific filament lamp and reflector combination will generate a very specific beam shape. H4, HS1, H13, H17, H19 lamps are examples of such automotive lamps, and their physical construction and light output characteristics are very closely regulated by appropriate standards. For example, halogen light sources are described and regulated in ECE R37, while ECE R112 regulates headlamps and their beam pattern.

Some lamps such as the H4 halogen lamp combine low beam and high beam functions in one lamp. Such a lamp comprises a glass vessel containing a halogen gas, with two filaments and a shield arranged at very specific positions to operate correctly when the lamp is mounted in a reflector that is part of a car headlamp. The design of the reflector is based on the principle of optics using the geometrical properties and position of the filaments and the shield inside the lamp vessel. For example, one filament may need to be positioned at the focal point of the reflector, while the other filament may need to be positioned somewhat further forward of the focal point and slightly above the axis. A cup-shaped shield positioned underneath the low beam filament can shield the low beam filament for example over an angle of 165°. The purpose of the shield is to partially block the light coming from the low-beam filament and the edges of the shield are used to generate a bright/dark cut-off line of the low beam pattern.

A disadvantage of lamps such as halogen lamps or filament lamps is their relatively short lifetime; another disadvantage is their relatively high power consumption. This is becoming more relevant as efforts are made to reduce fossil fuel consumption or to increase the range of electric automobiles. Furthermore, the color temperature of the light emitted by a lamp such as a halogen lamp is quite low, and may appear yellowish or "warm", whereas a "cooler" white light is often desired in automotive front lighting applications.

WO2015091462A1 and US20160290585A1 both disclose dual-function LED lamps providing a low as well as a high beam. Various positions and structures of the low-beam and high-beam LED light sources are shown, partly supported by a shield for forming the low beam.

It is an object of the invention to provide an LED lamp that can replace a filament lamp of the type described above, thus overcoming the associated problems.

SUMMARY OF THE INVENTION

The object of the invention is achieved by an inventive LED lamp, and by an inventive automotive front lighting arrangement.

According to the invention, the LED lamp comprises a lamp base realized for insertion into a reflector of an automotive front lighting assembly; a panel extending outward from the lamp base with a first vertical side arranged to face into one half of the reflector and a second vertical side arranged to face into the other half of the reflector; a primary light source comprising a set of LED dies on each vertical side of the panel; and a two-part shield comprising a first shield half arranged to shield the set of LED dies on the first vertical side of the panel and a second shield half arranged to shield the set of LED dies on the second vertical side of the panel; wherein the two-part shield essentially comprises the form of a shield in a functionally equivalent filament lamp. In this, "vertical" refers to when the lamp in the reflector is mounted in a car headlamp.

An advantage of the inventive LED lamp is that it can reliably imitate the performance of an existing type of lamp that is designed to fulfil a specific function. For example, some kinds of filament lamp are constructed to be used in conjunction with a reflector of a lighting unit in order to generate very specific beam forms. Such a beam form is the result of the combined characteristics of the filament lamp and the reflector in which it is mounted. It is very advantageous to be able to use the inventive LED lamp to replace such a filament lamp, since it is not necessary to also replace the reflector and any other optics of the lighting unit. Furthermore, LEDs consume much less electrical power than incandescent lamps or halogen lamps. Another very significant advantage of LEDs is that they can be designed to emit light at very high color temperatures. This is not possible with halogen lamps, for example, which emit light of a warmer color. Another feature of LED lamps is that their lifespan is very long. The inventive LED lamp is therefore a very attractive alternative to an existing type of halogen or filament lamp for an automotive front beam application.

The inventive lighting arrangement comprises such an LED lamp and a driver with suitable driver electronics for correctly driving the LEDs of the primary and, in some embodiments, the secondary light sources. The driver can be incorporated in the retrofit LED lamp, for example in the base of the lamp. The inventive lighting arrangement is preferably realized to be used in conjunction with a controller incorporated in an automobile or vehicle. Such a controller is generally realized to activate/deactivate the low beam and high beam in response to a user's action. Such a controller may be functionally the same as the controller of a filament lamp that is being replaced by the inventive LED lamp.

The dependent claims and the following description disclose particularly advantageous embodiments and features of the invention. Features of the embodiments may be combined as appropriate. Features described in the context of one claim category can apply equally to another claim category.

The inventive LED lamp can be used to replace an existing filament lamp, i.e. a "legacy" filament lamp. A "legacy" filament lamp is to be understood as a lamp with certain design constraints that must be adhered to, even if these are not functionally relevant to an LED lamp that will replace that filament lamp. The filament lamp being replaced by the inventive LED lamp may be referred to in the following simply as a "legacy lamp".

The number of LED dies or, for short, LEDs and/or the light output of each LED will determine the overall light output of the primary LED light source. Therefore, in a preferred embodiment of the invention, the primary light source comprises an array of at least two LEDs on each vertical side of the panel. Preferably, the primary light source comprises three LEDs arranged in a linear fashion on each side of the panel. The LED dies of the primary light source are preferably arranged on the panel to correspond to the position of a corresponding filament of the functionally equivalent filament lamp. For example, if the inventive lamp is to replace a certain filament lamp, the LED dies of the primary light source are arranged on the panel to correspond to the position of the filament of the functionally equivalent filament lamp, and the number of LEDs of the primary light source is chosen to achieve the light output of the filament of that functionally equivalent filament lamp. In such a realization, the LED retrofit lamp can be used in a headlamp originally designed for the halogen filament lamp.

Similarly, in some embodiments, the secondary light source also comprises a set of LED dies arranged on each vertical side of the panel. Here also, the LED dies of the secondary light source are preferably arranged on the panel to correspond to the position of a corresponding filament of a functionally equivalent filament lamp. For example, if the inventive lamp is to replace a two-filament lamp, the LED dies of the secondary light source are arranged on the panel to correspond to the position of the high-beam filament of the functionally equivalent H4 filament lamp. In this case also, the number of LEDs of the secondary light source can be chosen to achieve the light output of the corresponding filament of the functionally equivalent filament lamp. In such a realization, the LED retrofit lamp can be used in a headlamp originally designed for the two-filament halogen lamp. Furthermore, the inventive LED lamp also fulfils the function of low beam and high beam, originally fulfilled by the two filaments of the halogen lamp, as well as the shielding function to ensure a satisfactory bright/dark cut-off line for the low-beam.

In the inventive lighting arrangement, the controller is realized to control the LEDs of the LED lamp. When the LED lamp comprises both a primary light source and a secondary light source, the controller can be realized to control the LEDs of each light source independently. In other words, the controller can control the primary light source independently of the secondary light source. In a retrofit realization, for example, the controller can activate LEDs of the primary light source to generate a low beam, and/or it can activate LEDs of the secondary light source to generate a high beam. In a preferred embodiment of the invention, the controller can be realized to control the LEDs of a single light source independently of each other. For example, the controller of a retrofit $H_4$ LED lamp can activate all LEDs of the secondary light source, together with one or more LEDs of the primary light source, in order to generate the high beam. In this way, the LED lamp can be realized using less LEDs for the secondary light source and/or smaller LEDs for the secondary light source, since the secondary light source is augmented by one or more LEDs of the primary light source. In one exemplary embodiment, the primary light source can be realized as a linear arrangement of three LEDs on each side of the vertical panel, and the secondary light source can be realized as a linear arrangement of two LEDs on each side of the vertical panel. The primary and secondary light sources are close together so that, when the controller is to initiate a high beam, the LEDs of the secondary light source can be activated together with the "last" LED in the row of LEDs of the primary light source, i.e. the LED of the primary light source that is closest to the secondary light source.

An LED generates a significant amount of heat during operation. To protect the LEDs from heat damage, the inventive lamp preferably comprises a suitable heat-dissipating arrangement. In a preferred embodiment of the invention, the panel is realized to dissipate heat from the LED light sources. In this embodiment, the panel itself acts as a heat dissipating component or heat spreader. The heat is preferably removed in as direct a manner as possible from the lamp. When most or all of the LEDs are operational, the heat generated by the LEDs may be such that the panel is unable to dissipate the heat quickly enough. A possible solution may be to increase the dimensions of the panel in order to achieve a satisfactory heat dissipation capacity. However, for the lamp to mimic the positions of the filament(s) of an existing lamp design, there may be a limit to the panel dimensions such as length, width, thickness etc. Therefore, to achieve the desired heat transfer capacity, a preferred embodiment of the LED lamp comprises a heat dissipating part or heat sink mounted to the lamp base. The heat sink is preferably in direct thermal connection to the panel. For example, the body of the panel may extend into the lamp base for physical connection to a heat sink arranged on the other side of the reflector (the lamp itself is "inside" the reflector). In this way, any heat from the LEDs can spread through the panel into the heat sink and away from the lamp. The body of the heat sink is preferably as large as possible, and may be limited only by the space available behind the reflector. The heat sink can be formed from a solid block of metal such as aluminum or any other good thermal conductor. Preferably, the heat sink comprises a plurality of fins or similar elements to increase its surface area. With a suitable mass and a suitable choice of shape and material, the heat sink can be made to dissipate heat as efficiently as possible.

Depending on the type of filament lamp that it is intended to replace, the inventive lamp can comprise an anti-glare hood arranged at the outward end of the panel, i.e. towards the front of the lamp. A legacy lamp may require a standardized holder to assist in correct mounting and positioning of the lamp, as well as a connector for connecting the lamp to a power supply. Therefore, the inventive lamp preferably also comprises a number of connector tabs (electrical and/or mechanical), in compliance with any relevant regulations, to ensure correct mounting of the lamp in a reflector of a headlamp.

Other objects and features of the present invention will become apparent from the following detailed descriptions considered in conjunction with the accompanying drawings. It is to be understood, however, that the drawings are designed solely for the purposes of illustration and not as a definition of the limits of the invention.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
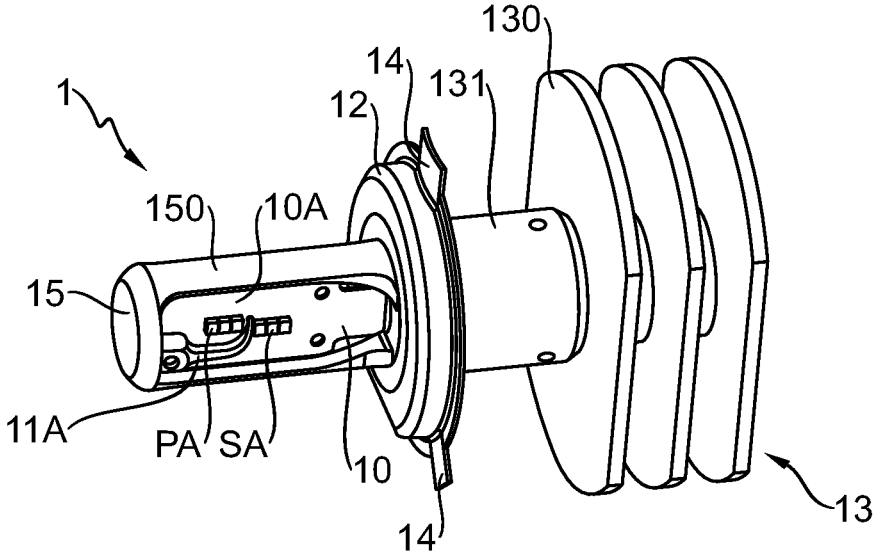
FIG. 1 shows a perspective side view of an embodiment of the inventive LED lamp.
Figure 2:
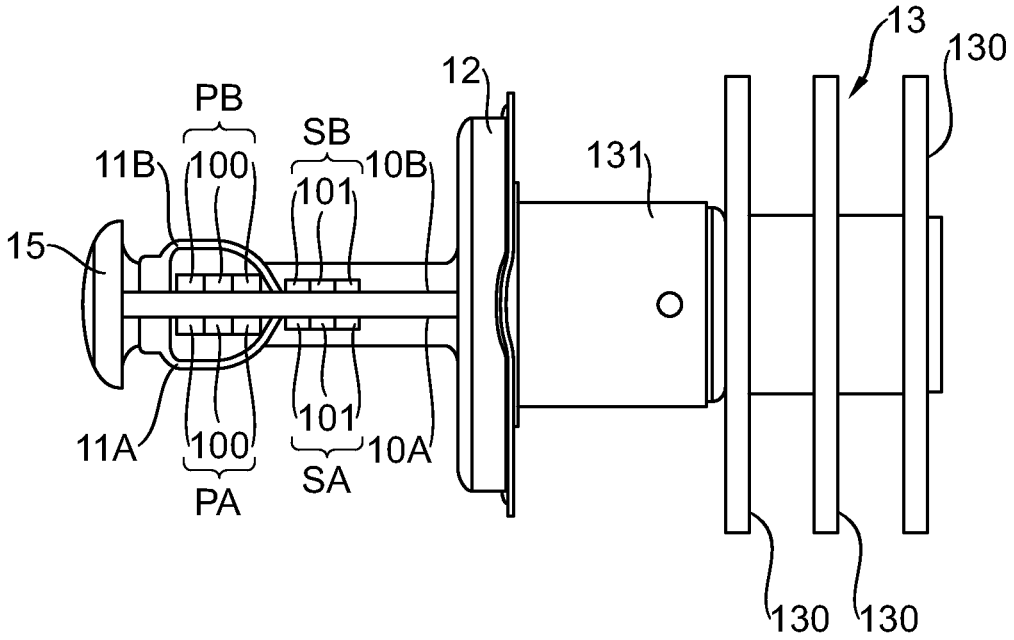
FIG. 2 shows a plan view of the embodiment of FIG. 1.

FIG. 1 shows an embodiment of the inventive LED lamp 1 realized as a retrofit lamp to replace a conventional or legacy halogen two-filament lamp (as described in FIG. 8 below). The diagram illustrates the similarity in shape to the legacy lamp 8 of FIG. 8. The lamp body is similar in shape and proportion to the glass vessel of the legacy lamp 8, and comprises a panel 10 extending outward from a lamp base 12 and arranged such that a first vertical side 10A will face into one half of a reflector (not shown) and a second vertical side 10B will face into the other half of the reflector. The lamp base 12 is realized for insertion into the reflector 20 of an automotive front lighting assembly and comprises a number of tabs 14 that aid in correct positioning of the lamp 1 in the reflector. In this exemplary embodiment, the lamp base 12 terminates in a connector that is inserted into a corresponding connector 131 extending from a heat sink 13. A driver for the LEDs 100, 101 can be incorporated into the lamp base 12 or, alternatively, in the connector 131. When inserted into the reflector, the panel 10 will be in thermal contact with the heat sink 13, which can efficiently dissipate the heat generated by the LEDs during operation. An anti-glare cap 15 is arranged towards the front end of the lamp 1 in keeping with the regulation applicable to the legacy lamp, and is held in place by a cap mount 150 extending between the cap 15 and the lamp base 12. FIG. 2 shows a plan view of the same lamp 1, and omits a part of the cap mount 150 for clarity.

The filaments of the legacy lamp are mimicked by sets of LEDs. To this end, a primary light source P, which will be used to generate a low beam, comprises a set PA, PB of LED dies 100 on each vertical side 10A, 10B of the panel 10. In FIG. 1, only one set PA is visible, arranged on one side 10A of the panel 10. The other set PB is arranged on the other side 10B of the panel 10 and can be seen in FIG. 2. The positions of the primary light source LED sets PA, PB are such to mimic the position of a low-beam filament 81 in the lamp 8 described in FIG. 8. A two-part shield 11 comprises a first shield half 11A arranged to shield the LED set PA on the first vertical side 10A of the panel 10, and a second shield half 11B that is arranged to shield the other LED set PB. The two-part shield 11 has the same size and shape as the shield 83 of the legacy lamp 8 described in FIG. 8.

The LED lamp 1 also has a secondary light source S to generate a high beam, with a set SA, SB of LED dies 101 on each vertical side 10A, 10B of the panel 10. Again, only one set SA is visible in FIG. 1, and the other set SB arranged on the other side 10B of the panel 10 can be seen in FIG. 2. The positions of the secondary LED sets SA, SB are such to mimic the position of a high-beam filament 82 in the lamp 8 described in FIG. 8. The number of LED dies in each set PA, PB, SA, SB is chosen to achieve the desired lumen output, which should correspond to the lumen output of the legacy lamp.

To correctly mimic the long or rectangular shape of a filament, each LED die set PA, PB, SA, SB consists of several LED dies 100, 101 arranged in a row. In this embodiment, each filament is mimicked by a linear arrangement of three LEDs 100, 101. The LED die rows are arranged to correspond to the positions of the filaments in the vessel of the legacy lamp. FIG. 1 shows that the row PA of low beam LED dies 100 is slightly higher than the row SA of high-beam LED dies 101.

Figure 3:
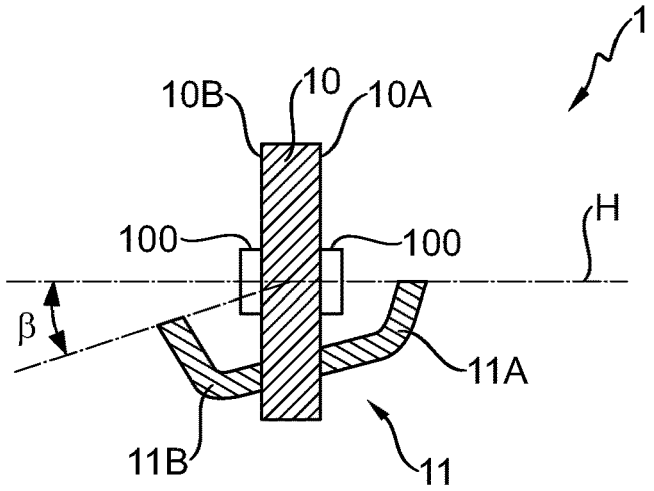
FIG. 3 shows a cross-section through an embodiment of the inventive lamp.

FIG. 3 shows a cross-section through an embodiment of the inventive lamp 1, looking in the direction of the lamp base. The cross-section is taken vertically through one of the LEDs 100 of the primary light source P. The diagram shows the panel 10, which can be a suitable carrier 10 such as a printed circuit board (PCB) in which tracks are formed to electrically connect to the LEDs 100 mounted on either side 10A, 10B of the panel 10. A shield half 11A is mounted to one side 10A of the panel 10, and a complementary shield half 11B is mounted to the other side 10B of the panel 10. The shield halves 11A, 11B are shown to act collectively as a comparable shield of a legacy lamp as shown in FIG. 8. The shield spans an arc of less than 180°, so that one side is lower by an angle β subtended from a horizontal plane H that contains the focal line of the reflector (not shown). For a H4 lamp, for example, this angle β will comprise 15° so that the shield 11 spans an arc of 165°. The LEDs 100 of the primary light source PA, PB are arranged on the panel 10 to lie in the position that would be occupied by the corresponding filament of the legacy lamp.

Figure 4:
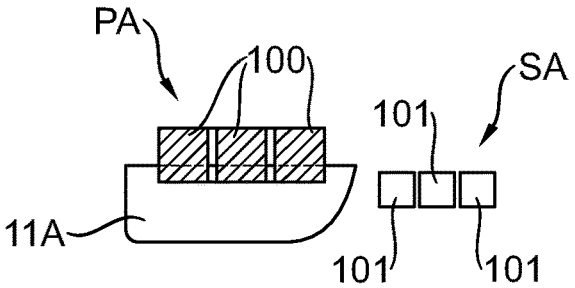
FIG. 4 illustrates generation of a low beam for an embodiment of the inventive LED lamp.
Figure 5:
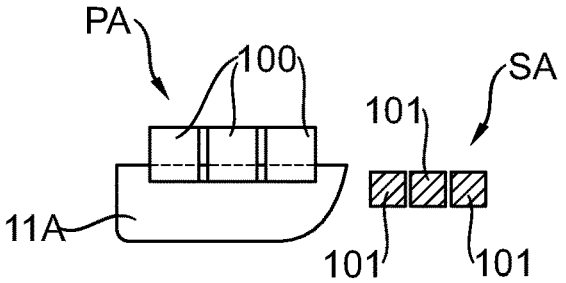
FIG. 5 illustrates generation of a high beam for the LED lamp of FIG. 4.
Figure 6:
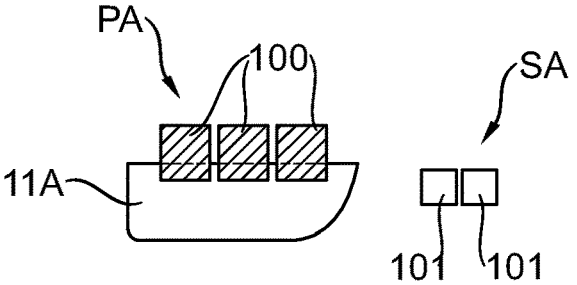
FIG. 6 illustrates generation of a low beam for a further embodiment of the inventive LED lamp.
Figure 7:
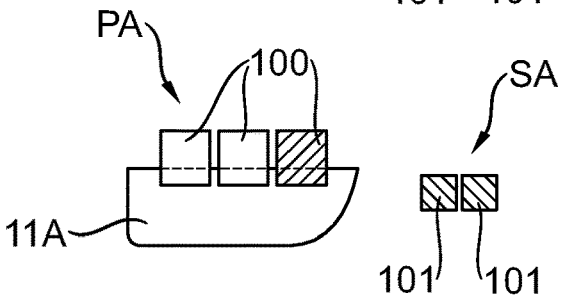
FIG. 7 illustrates generation of a high beam for the LED lamp of FIG. 6.

FIGS. 4-7 illustrate how a low beam or a high beam might be generated for different embodiments of the inventive LED lamp. In the diagrams, LED sets PA, SA on one side only of the panel 10 are shown, and it may be assumed that the LED sets PB, SB on the other side of the panel 10 are activated/deactivated in the same manner. A simplified outline of the shield half 11A is indicated by a dashed line. In FIG. 4, a low beam is being generated using the LEDs 100 of the primary light source P, as indicated by the hatching fill pattern. The LEDs 101 of the secondary light source are not turned on (in response to a user's action to turn on only the low beam). In FIG. 5, a high beam is being generated using the LEDs 101 of the secondary light source, as indicated by the hatching fill pattern. The LEDs 100 of the primary light source are not turned on. FIG. 4 and FIG. 5 relate to the same embodiment of the inventive LED lamp. FIG. 6 and FIG. 7 relate to an alternative embodiment of the inventive LED lamp. In FIG. 6, a low beam is being generated using the LEDs 100 of the primary light source, as indicated by the hatching fill pattern. The LEDs 101 of the secondary light source are not turned on. In this embodiment, the secondary light source comprises an array of only two LEDs 101 on each side of the panel 10, and "borrows" an LED 100 of each set of the primary light source P. In FIG. 7, a high beam is being generated using one of the LEDs 100 of the primary light source P in addition to the LEDs 101 of the secondary light source S, as indicated by the hatching fill pattern. The other two LEDs 100 of the primary light source are not turned on. It is of course possible to turn on both low beam and high beam simultaneously for the embodiment shown in FIGS. 4 and 5 and the embodiment shown in FIGS. 6 and 7.

Figure 8:
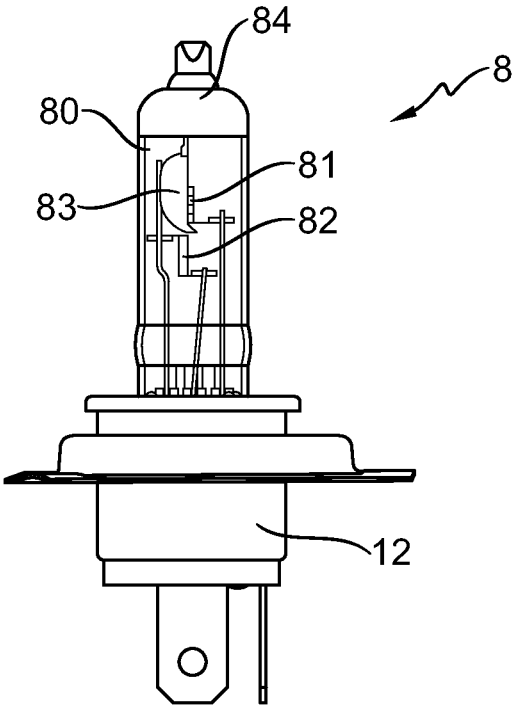
FIG. 8 (prior art)
FIG. 8 shows a prior art H4 halogen lamp.

FIG. 8 shows a halogen lamp 8 that combines low beam and high beam functions. Examples of such filament lamps are H4, HS1, H13, H17, H19 etc. The lamp 8 comprises a glass vessel 80 filled with a halogen gas. Two filaments 81, 82 and a shield 83 are arranged inside the vessel 80. An anti-glare cap 84 at the front of the vessel 80 shields oncoming traffic from glare. The filaments 81, 82 as well as the shield 83 are geometrically arranged in standardized positions in order to be able to operate correctly in a reflector that is part of a car headlamp. The cup-shaped form and the edges of the shield 83 play a significant role in correctly shielding the low beam filament 81, preventing its light from entering the dedicated high beam region of the reflector. The lamp 8 has a standardized form with three tabs to ensure correct positioning when the lamp 8 is mounted into the headlamp reflector.

Figure 9:
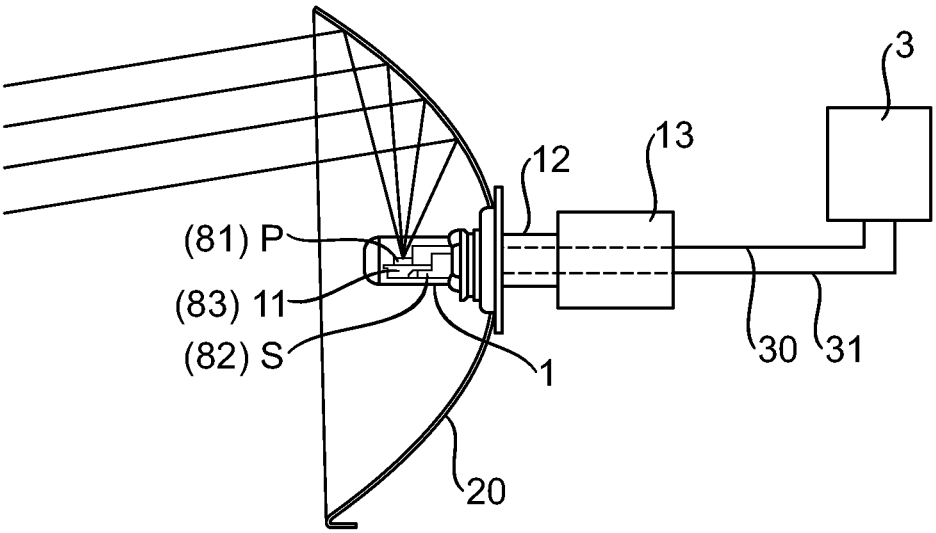
FIG. 9 shows an embodiment of the inventive lamp arranged in a reflector.

FIG. 9 shows a H4-type LED lamp 1 arranged in a reflector 20 of an automotive front lighting unit. The diagram serves to show that the reflector 20 is designed for use with a legacy H4 two-filament halogen lamp (such as that shown in FIG. 8) but instead a suitable embodiment of the inventive LED lamp 1 is inserted into the reflector 20. The same controller 3 is used to activate/deactivate the low and high beams in response to a user's actions.

Here, the position of the primary light source P corresponds to the position of the low-beam filament 81 of the legacy halogen lamp; the position of the secondary light source S corresponds to the position of the high-beam filament 82 of the legacy lamp; and the shield 11 corresponds in shape and position to the shield 83 of the legacy lamp. The LEDs of the primary and secondary light sources P, S can be controlled collectively or individually as explained above by means of the controller 3. The controller 3 is electrically connected to a driver arranged in the base of the lamp 1 by means of leads 30, 31 extending through the heat sink 13 to reach the standard connector terminals at the lamp base 12. The lamp connector and base 12 can have the standardized form as shown in FIG. 8.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

LIST OF REFERENCE SIGNS

LED lamp 1
panel 10
vertical side 10A, 10B
two-part shield 11
shield halves 11A, 11B
lamp base 12
heat sink 13
fins 130
connector 131
tab 14
glare cap 15
cap mount 150
reflector 20
controller 3
leads 30, 31
filament lamp 8
lamp vessel 80
filaments 81, 82
shield 83
anti-glare cap 84
primary/secondary light source P, S
LED arrays PA, PB, SA, SB
LEDs 100, 101
horizontal plane H
angle β

The invention claimed is:

1. An LED lamp for installation in an automotive front lighting assembly, comprising:

a lamp base configured to be insertable into a reflector of the automotive front lighting assembly;

a panel extending outward from the lamp base, the panel comprising a first side and a second side oppositely positioned from the first side;

a primary light source configured to produce a low beam, the primary light source comprising a first set of primary LED dies disposed on the first side of the panel and a second set of primary LED dies disposed on the second side of the panel;

a two-part shield comprising a first part arranged to shield the first set of primary LED dies and a second part arranged to shield the second set of primary LED dies, the first part arranged asymmetrically with the second part about the panel; and a secondary light source configured to produce a high beam, the secondary light source comprising a first set of secondary LED dies disposed on the first side of the panel and a second set of secondary LED dies disposed on the second side of the panel.

2. The LED lamp according to claim 1, wherein the first and second sets of primary LED dies of the primary light source comprises an array of three primary LED dies.

3. The LED lamp according to claim 1, wherein the first and second sets of secondary LED dies of the secondary light source comprises an array of at least two secondary LED dies.

4. The LED lamp according to claim 1, further comprising an anti-glare cap disposed to have the panel between the anti-glare cap and the lamp base.

5. The LED lamp according to claim 1, comprising a driver incorporated in the lamp base.

6. An automotive front lighting arrangement comprising the LED lamp according to claim 1;

the reflector to receive the LED lamp; and an electrical interface for connecting to a controller of the automotive front light arrangement.

7. The automotive front lighting arrangement according to claim 6, wherein the driver of the LED lamp is configured to activate the primary LED dies of the primary light source to generate the low beam, and to activate the primary LED dies of the secondary light source to generate a high beam, in response to a signal from the controller.

8. The automotive front lighting arrangement according to claim 7, wherein the driver is configured to activate a primary LED die of the primary light source in addition to the secondary LED dies of the secondary light source to generate the high beam.

9. The automotive front lighting arrangement according to claim 7, wherein the primary LED die of the primary light source to be activated by the driver in addition to the secondary LED dies of the secondary light source to generate the high beam is a primary LED die of the primary light source closest to the secondary light source.

10. The automotive front lighting arrangement according to claim 6, comprising a heat dissipating part connected to the lamp base of the LED lamp to achieve thermal connection to the panel.

11. The automotive front lighting arrangement according to claim 10, wherein the heat dissipating part comprises a plurality of fins.

12. The LED lamp according to claim 1, wherein the LED dies within the first and second sets of LED dies of the primary light source are arranged in a row.

13. The LED lamp according to claim 1, wherein the LED dies within the first and second sets of LED dies of the secondary light source are arranged in a row.

14. The LED lamp according to claim 1, wherein the first and second sets of LED dies of the primary light source each comprises three LED dies arranged in a row.

15. The LED lamp according to claim 1, wherein the two-part shield spans an arc of less than 180° with respect to a horizontal plane perpendicular to a first direction, the panel has a height along a first direction and a length along a second direction perpendicular to the first direction and extending outward from the lamp base, the second direction parallel to the horizontal plane.

16. The LED lamp according to claim 1, wherein one of the first part and the second part of the two-part shield is lower than the other by an angle of 15° subtended from the horizontal plane.

17. An LED lamp for installation in an automotive front lighting assembly, comprising:

a lamp base configured to be insertable into a reflector of the automotive front lighting assembly;

a panel extending outward from the lamp base, the panel comprising a first side and a second side oppositely positioned from the first side;

a primary light source configured to produce a low beam, the primary light source consisting of three primary LED dies disposed on the first side of the panel and of three primary LED dies disposed on the second side of the panel;

a two-part shield comprising a first part arranged to shield the three primary LED dies disposed on the first side of the panel and a second part arranged to shield the three primary LED dies disposed on the second side of the panel; and a secondary light source configured to produce a high beam, the secondary light source consisting of three or less secondary LED dies disposed on the first side of the panel and three or less secondary LED dies disposed on the second side of the panel.

18. The LED lamp according to claim 17, wherein the three or less secondary LED dies disposed on the first side of the panel consists of two secondary LED dies, and the three or less secondary LED dies disposed on the second side of the panel consists of two secondary LED dies.

* * * * *